United States Patent [19]

Kim et al.

[11] 3,969,112

[45] July 13, 1976

[54] PROCESS FOR PREPARING SILVER-CADMIUM OXIDE ALLOYS

[75] Inventors: Han J. Kim, Chelmsford; F. Joseph Reid, Acton, both of Mass.

[73] Assignee: GTE Laboratories Incorporated, Waltham, Mass.

[22] Filed: Nov. 11, 1974

[21] Appl. No.: 521,609

[52] U.S. Cl. ..... 75/206; 29/182.5; 75/211; 75/221

[51] Int. Cl.[2] ..... B22F 8/00; B22F 3/00; C22C 1/04; C22C 28/00

[58] Field of Search ..... 75/206, 211, 221; 29/182.5

[56] References Cited

UNITED STATES PATENTS

| | | | |
|---|---|---|---|
| 3,114,631 | 12/1963 | Sistare et al. | 29/182.5 |
| 3,385,677 | 5/1968 | Schreiner et al. | 75/206 |
| 3,506,437 | 4/1970 | Gwyn | 29/182.5 |
| 3,799,772 | 3/1974 | Zdanuk et al. | 29/182.5 |

*Primary Examiner*—Benjamin R. Padgett
*Assistant Examiner*—Josephine Lloyd
*Attorney, Agent, or Firm*—Irving M. Kriegsman

[57] ABSTRACT

This application describes the addition of an alkali metal, generally in the form of a salt thereof, to a mixture of silver and cadmium oxide, prior to the sintering step, to improve the as-sintered densities of the resultant alloy material.

13 Claims, No Drawings

PROCESS FOR PREPARING SILVER-CADMIUM OXIDE ALLOYS

FIELD OF THE INVENTION

This application relates to the field of metallurgy. More particularly, it relates to a process for improving the as-sintered densities of a silver-cadmium oxide alloy material.

BACKGROUND OF THE INVENTION

Sintered silver-cadmium oxide contact members are useful for high electrical current applications. Difficulties experienced in attaining densification during sintering are attributable to the morphology associated with such sintered materials where pores and cadmium oxide particles are present in the silver grain boundaries. Because of the dissociation of cadmium oxide during sintering and the insolubility of cadmium oxide in the silver matrix, the maximum density of silver-cadmium oxide contacts obtained as-sintered is typically less than the theoretical density.

Such silver-cadmium oxide contact members are prepared by pressing a mixture of silver and cadmium oxide powders into a compact, and then sintering this compact by heating the pressed compact to a temperature of about 900°C and holding the compact at about that temperature for about 1 hour. The compact normally does not fully densify during the sintering process. In order to achieve a fully dense silver-cadmium oxide product, the sintered product must be further compacted by cold working, as by rolling and repressing. During these cold working processes crack initiation can occur thus resulting in an inferior material that has a less than optimum ductility and a lower than optimum fracture strength. Although a fully dense product usually can be obtained through such mechanical working, the total silver to silver metallurgical bond remains little increased, thus resulting in inferior arc-erosion resistance. It would, accordingly, be desirable to have a sintering process which is not subject to the aforementioned disadvantages. That is, it would be desirable to have a sintering process which yields a product having "full density".

OBJECTS OF THE PRESENT INVENTION

It is, therefore, the primary object of this invention to provide an improved process for preparing silver-cadmium oxide alloys for use in forming electrical contact members.

A further object of this invention is to provide a process for preparing silver-cadmium oxide alloys which results in alloys having improved as-sintered densities as high as on the order of 99% of theoretical.

A further object of this invention is to provide novel silver-cadmium oxide alloys having improved as-sintered densities as high as on the order of 99% of theoretical.

Yet a further object of this invention is to provide novel additive-containing silver-cadmium oxide mixtures useful in the improved process of this invention to provide the novel silver-cadmium oxide alloys having improved as-sintered densities as high as on the order of 99% of theoretical.

These and still further objects, features and advantages of the present invention will be more apparent from a consideration of the following more detailed explanation of the present invention.

SUMMARY OF THE INVENTION

These and still further objects, features and advantages of the present invention are achieved, in accordance therewith, by adding to the silver and cadmium oxide to be sintered an additive in the form of an alkali metal or alkaline earth metal salt, heating a pressed compact of the additive containing silver-cadmium oxide to a temperature below the sintering temperature for a period of time sufficient to decompose the additive, and then sintering the compact according to conventional techniques. It is essential in this process that the additive is decomposed before sintering if one wishes to achieve the high as-sintered densities on the order of 99% of theoretical.

Suitable additives include the alkali metal or alkaline earth metal salts of inorganic acids, particularly nitric acid, as, for example, lithium nitrate, strontium nitrate, rubidium nitrate, cesium nitrate, and the like, which decompose at elevated temperatures below the sintering temperature to be employed. Lithium salts, particularly lithium nitrate, are presently preferred.

The silver-cadmium oxide blend will generally have about 10% to 15% cadmium oxide and about 90% to 85% silver, although blends having about 5% to 30% cadmium oxide and about 95% to 70% silver, respectively, can also be used.

The additive can be added to the silver-cadmium oxide prior to the sintering process by a direct addition or as a solution thereof, the concentration of the solution is not critical as long as it is below the saturation limit of the solvent. The total amount of the additive added to the silver-cadmium oxide is about 0.05 to about 0.5%, preferably about 0.1 to 0.2%, based on the total weight of the silver-cadmium oxide. The additive solution is removed by vaporization and a pressed compact of the silver-cadmium oxide containing the additive is heated to an elevated temperature, somewhat below the final sintering temperature, at a slow heating rate and in some cases held at that temperature for a sufficient period of time to decompose the additive. Thereafter, the compact is heated to, and held at, the final sintering temperature for the desired period of time according to conventional practice. The resultant product has an improved density, without further processing, as high as on the order of 99% of theoretical.

The microstructure of the alloys of the present invention shows a more uniform cadmium oxide particle size distribution and a pronounced decrease in pore population as compared to alloys prepared by the old method. This improved morphology was also revealed in scanning electron fractographs, which additionally showed a significant increase in the silver-to-silver bond area and a decrease in the pore volume as evidenced by a tight silver-cadmium oxide interface structure. A 33% increase in the Knoop hardness over the standard silver-cadmium oxide contact was obtained, which is consistent with the high as-sintered densities obtained with the alloys of this invention.

In a comparative study, both the high density 85% silver—15% cadmium oxide contact having 99% of theoretical density and a 94% dense standard contact were rolled into sheet forms and annealed for tensile testing. The total reduction was about 75%. After rolling and annealing, both the contact material with the additive and the standard contact material had a density of 99% to 100% of theoretical. An increase of tensile strength from 1970 kg/cm$^2$ to 2330 kg/cm$^2$ was observed for the high as-sintered density contact. Elongation also increased approximately two-fold indicating a substantial improvement in toughness. The increased Knoop hardness from 55 kg/mm$^2$ to 73 kg/mm$^2$ and an increase in the silver to silver bond with resultant decrease in the number of stress raisers, such as pores, in the high as-sintered density contact are believed to be responsible for such improvement. A mere increase in density by cold-working does not bring about the sound microstructure required for high ductility and toughness.

The increase in toughness and ductility implies increased rollability and drawability. For example, it is possible to achieve greater than 80% reduction in thickness by cold-rolling the high density material without intermediate annealing, whereas, by comparison, the standard material cannot be reduced in thickness to this degree. This improvement in physical properties is beneficial in terms of decreasing the repeated rolling-annealing steps currently employed for making contacts by coining from rolled sheet and in terms of facilitating the wiredrawing process. It is also contemplated that the improved mechanical properties of the contact member will produce beneficial effects in the operation of electrical devices utilizing these contact members.

Another ramification of the high density sintered contact lies in that the CdO content can be substantially increased from the normal 10% to 15%. Lithium nitrate additions ranging from 0.1 to 0.2 wt. % to 20, 25 and 30% CdO-silver contacts have resulted in as-sintered densities of 99% of theoretical. Such high CdO-containing silver contacts have not been available due to poor mechanical properties associated with the poor as-sintered density in the sintered contact and with the heavy CdO precipitation at grain boundaries in the internal oxidized contact.

The electrical conductivity of the high density 85% silver—15% cadmium oxide contacts as prepared, after pressing, after annealing, and after cold-working and annealing is fully equivalent to values obtained with the standard contact materials. Such high electrical conductivity obtainable without rolling and the high as-sintered density opens a possibility of eliminating the rolling, annealing and stamping steps currently employed in industry in making such contacts.

DESCRIPTION OF SPECIFIC EMBODIMENTS

The following Examples are given to enable those skilled in this art to more clearly understand and practice the present invention. They should not be considered as a limitation upon the scope of the invention, but merely as being illustrative and representative thereof.

EXAMPLE I

3 G of a mixture containing 85% silver particles and 15% cadmium oxide particles is pressed using a pressure of 560 kg/cm$^2$ to obtain compacts 0.2 cm in thickness having approximately 50% porosity. The silver and cadmium oxide particle sizes are of the order of 1 $\mu$m. The resultant compact is immersed in a $LiNO_3$ solution containing 0.2 g of lithium nitrate in 10 ml of $H_2O$ for 30 min. in order to infiltrate the pores with solution. The lithium nitrate addition amounts to about 0.2 wt. % of the weight of the silver-cadmium oxide compact. The $LiNO_3$-infiltrated compact is heated to 650°C at 15°C/min. and held at that temperature for 2 hours to effect the decomposition of the additive, followed by heating the compact to 900°C at 30°C/min. and holding at that temperature for 1 hour for final sintering. The resultant product has an as-sintered density of 99.5% of theoretical density as compared to an as-sintered density of 94.3% of theoretical density for the standard product obtained without the $LiNO_3$ additive. A rolled and annealed tensile specimen from the resultant product has an ultimate tensile strength of 2340 kg/cm$^2$ which is 18% higher than that of the standard product and an elongation of 18% which is 100% higher than that of the standard product.

EXAMPLE II

The procedure of Example I is repeated using about 0.1 wt. % of the lithium nitrate addition. The sintered compact had a density of 99.3% of theoretical density.

EXAMPLE III

The procedure of Example I is repeated using strontium nitrate as the additive at a concentration of about 0.1 wt. % in a 1 gram sample of a mixture containing 90% silver and 10% cadmium oxide. The sintered product had a density of 98.5% of theoretical as compared to a density of 97.3% of theoretical for the standard product.

EXAMPLE IV

The procedure of Example I is repeated using 1 g of lithium nitrate in 100 ml of methanol as the solvent for the $LiNO_3$ infiltration solution. The $LiNO_3$ addition amounts to about 0.1 wt. %. The $LiNO_3$ infiltrated compact is heated to 900°C at 13°C/min. and held at that temperature for one hour to effect sintering. The sintered product has the same improved high density as the sintered product of Example I.

EXAMPLE V

The procedure of Example IV is repeated using 0.6 g of a mixture of 90% silver and 10% cadmium oxide and 0.44 g of lithium nitrate in 100 ml of methanol as the solvent for the $LiNO_3$ infiltration solution. The $LiNO_3$ addition amounts to about 0.4 wt. %. The sintered product has a density of 99.3% of theoretical, as compared to 97.3% of theoretical for the standard product.

EXAMPLE VI

The procedure of Example IV is repeated using a mixture of 80% silver and 20% cadmium oxide. The sintered product has a density of 99% of theoretical. A rolled and annealed tensile specimen from the resultant sintered product has an ultimate tensile strength of 2350 kg/cm$^2$ which is 18% higher than that of the standard product and an elongation of 15% which is 87% higher than that of the standard product.

EXAMPLE VII

The procedure of Example IV is repeated using a mixture of 75% silver and 25% cadmium oxide. The sintered product has a density of 99.1% of theoretical. A tensile specimen from the resultant product has an ultimate tensile strength of 2480 kg/cm$^2$ which is 45% higher than that of the standard product and an elongation of 10% which is 400% higher than that of the standard product.

EXAMPLE VIII

The procedure of Example IV is repeated using a mixture of 70% silver and 30% cadmium oxide. The sintered product has a density of 99% of theoretical. A tensile specimen from the resultant product has an ultimate tensile strength of 2290 kg/cm$^2$ which is about 50% higher than that of the standard product and an elongation of 3% which is over 500% higher than that of the standard product.

EXAMPLE IX 0.03 G of lithium nitrate is dissolved in 25 ml. of distilled water, and 25 ml. of the resultant solution is added, with stirring, to 20 g of a mixture containing 85% silver and 15% cadmium oxide. Lithium nitrate addition amounts to 0.15 wt. % of the weight of the silver-cadmium oxide mixture. The water from the lithium nitrate solution is removed through vaporization. A compact is formed and sintered by the procedure of Example I. The resultant product has an as-sintered density of 99% of theoretical, as compared to 94.3% of theoretical for the standard sample.

EXAMPLE X

The procedure of Example IX is repeated using cesium nitrate as the additive at a concentration of about 0.8 wt. %. The sintered product had a density of 96.1% of theoretical, as compared to 94.3% for the standard product.

EXAMPLE XI

The procedure of Example IX is repeated using rubidium nitrate as the additive at a concentration of about 0.7 wt. %. The sintered product had a density of 95.9% of theoretical, as compared to 94.3% for the standard product.

While not intending to be bound to the following explanation, the following proposed mechanism is presently believed to be the basis for the attainment of the high as-sintered densities achieved with the present invention.

The attainment of high density through the additive incorporation in the silver-cadmium oxide material is not believed to be caused by a conventional liquid phase sintering. This finding is based on the facts that a small amount of the additive required, e.g., 0.4 to about 0.8 vol. % $LiNO_3$, for full densification and that molten lithium nitrate is stable only to 600°C, a temperature far below the sintering temperature of about 900°C. In conventional liquid phase sintering, the minimum liquid phase required is about 5 vol. % and the maximum 50 vol. %.

In the temperature range for the existence of the molten lithium nitrate (250° to 600°C), a small degree of densification enhancement is believed to occur due to regrouping of the particles under the influence of capillary pressure, as in the case of liquid phase sintering. After complete decomposition of the molten lithium nitrate to solid lithium oxide and gaseous nitrogen oxides, and upon further heating to higher temperatures, the solid lithium oxide deposited on the cadmium oxide surface reacts with cadmium oxide to form a lithium-cadmium double oxide. This reaction product melts at 690°C according to differential thermal analysis.

The newly formed phase appears to play the important role of suppressing the vaporization of cadmium oxide, which becomes appreciable at about 700°C. Lowering of the cadmium oxide vapor pressure inside the closed pores facilitates the continuous movement of the silver grain boundaries in accordance with the rules of solid phase sintering. It is postulated that the build-up of a high cadmium oxide vapor pressure, for example, on the order of $10^{-4}$atm. at 800°C, in the pores has been mainly responsible for the poor as-sintered density of the conventional silver-cadmium oxide contact. The enhanced densification occurring after the decomposition step at 650°C was experimentally determined using a dilatometer technique. Additional evidence of the formation of the densification-aiding compound is the fact that, with increasing cadmium oxide content, the optimum lithium nitrate content required increases in accordance with the hypothesis. A decrease in the cadmium loss in the high density contact also corroborates the proposed mechanism of suppression of cadmium oxide vaporization by lithium oxide resulting in the high density silver-cadmium oxide contact material.

Metallographic examination of the high density silver-cadmium oxide contact also confirms the reaction between cadmium oxide and lithium oxide. When using the lithium additive during sintering, the cadmium oxide particles in the silver matrix are transformed to a more rounded morphology as compared to particles with well-defined facets formed in the old method. An accompanying reduction in the number of large cadmium oxide aggregates is achieved as determined by quantitative metallography.

In summary, there has been described herein a novel method for achieving near-theoretical, high density sintered silver-cadmium oxide contact members with improved morphology. By elimination of the extensive defect-producing post-sintering steps now required (in the old method) to bring the alloys to full density, an alloy having improved properties is obtained.

While the present invention has been described with reference to specific embodiments thereof, it should be understood by those skilled in this art that various changes may be made and equivalents may be substituted without departing from the true spirit and scope of the invention. In addition, many modifications can be made to adapt a particular situation, material or composition of matter, process, process step or steps, or then-present objective to the spirit of this invention without departing from its essential teachings.

What is claimed is:

1. A method for preparing a silver-cadmium oxide alloy comprising forming a compact of silver particles, cadmium oxide particles and a density-increasing additive selected from the group consisting of the alkali metal and alkaline earth metal salts of nitric acid; heating said additive-containing compact to a temperature below the final sintering temperature for a period of time sufficient to decompose said additive; and then sintering said heated compact to form a silver-cadmium oxide alloy having improved sintered density as compared to alloys prepared without said additive.

2. The method of claim 1 wherein said compact contains about 70% to about 95% silver particles and about 30% to about 5% cadmium oxide particles.

3. The method of claim 2 wherein said additive-containing compact contains about 0.05% to about 0.5% of said density-increasing additive.

4. The method of claim 1 wherein said additive-containing compact contains about 85% silver particles, about 15% cadmium oxide particles, and about 0.1% to about 0.2% of said density-increasing additive.

5. The method of claim 1 wherein said density-increasing additive is lithium nitrate.

6. The method of claim 5 wherein said additive-containing compact is heated to about 600°–700°C for about 1–4 hours to decompose said lithium nitrate.

7. The method of claim 1 wherein said additive-containing compact is formed by providing a blend of silver particles, cadmium oxide particles and said density-increasing additive, and pressing at high pressure said blend to form said additive-containing compact.

8. The method of claim 1 wherein said additive-containing compact is formed by pressing at high pressure a blend of silver and cadmium oxide particles to form a compact, and thereafter treating said compact with a solution of said density-increasing additive.

9. The method of claim 1 wherein said silver-cadmium oxide alloy has a sintered density of about 99% of theoretical.

10. The method for preparing a silver-cadmium oxide alloy comprising forming a compact comprising about 15% finely-divided cadmium oxide particles, about 85% finely-divided silver particles, and about 0.1 to about 0.2% lithium nitrate based upon the total weight of said silver and said cadmium oxide; heating said compact at about 600°–700°C for about 1–4 hours to decompose said lithium nitrate; and thereafter heating said compact at about 850°–950°C for about ½ – 2 hours to form a silver cadmium oxide alloy having an as-sintered density of about 99% of theoretical.

11. A method for preparing a silver-cadmium oxide alloy comprising forming a compact of about 70–95% silver particles, about 5–30% cadmium oxide particles, and about 0.05–0.5% of a density-increasing additive selected from the group consisting of the alkali metal and alkaline earth metal salts of nitric acid; heating said additive-containing compact to a temperature below the final sintering temperature for a period of time sufficient to decompose said additive; and then sintering said heated compact to form a silver-cadmium oxide alloy having improved sintered density as compared to alloys prepared without said additive.

12. The method of claim 11 wherein said additive is lithium nitrate.

13. The method of claim 11 wherein said silver-cadmium oxide alloy has a sintered density of about 99% of theoretical.

* * * * *